US010145519B1

(12) United States Patent
Portinga

(10) Patent No.: US 10,145,519 B1
(45) Date of Patent: Dec. 4, 2018

(54) ADJUSTABLE OPTIC AND LIGHTING DEVICE ASSEMBLY

(71) Applicant: Troy-CSL Lighting Inc., City of Industry, CA (US)

(72) Inventor: Joshua Portinga, City of Industry, CA (US)

(73) Assignee: TROY-CSL LIGHTING INC., City of Industry, CA (US)

( * ) Notice: Subject to any disclaimer, the term of this patent is extended or adjusted under 35 U.S.C. 154(b) by 0 days.

(21) Appl. No.: 15/984,008

(22) Filed: May 18, 2018

Related U.S. Application Data

(63) Continuation of application No. 15/828,243, filed on Nov. 30, 2017.

(51) Int. Cl.

| | |
|---|---|
| ***F21S 2/00*** | (2016.01) |
| ***F21V 15/01*** | (2006.01) |
| ***F21V 29/70*** | (2015.01) |
| ***F21V 21/04*** | (2006.01) |
| *F21Y 115/10* | (2016.01) |

(52) U.S. Cl.
CPC ..... *F21S 2/005* (2013.01); *F21V 15/01* (2013.01); *F21V 21/04* (2013.01); *F21V 29/70* (2015.01); *F21Y 2115/10* (2016.08)

(58) Field of Classification Search
USPC ..... 362/294
See application file for complete search history.

(56) References Cited

U.S. PATENT DOCUMENTS

| | | | | |
|---|---|---|---|---|
| 3,124,309 | A | 3/1964 | Cantoni et al. | |
| 8,398,271 | B2 | 3/2013 | Chan | |
| 9,255,676 | B2 | 2/2016 | Hoog | |
| 9,618,163 | B2 | 4/2017 | Power et al. | |
| 9,664,353 | B2 | 5/2017 | Maliar et al. | |
| 9,982,855 | B1 * | 5/2018 | Tan | F21V 3/061 |
| 2011/0267834 | A1 | 11/2011 | Potucek et al. | |

FOREIGN PATENT DOCUMENTS

| | | | |
|---|---|---|---|
| JP | 6164928 | B2 | 7/2017 |
| WO | WO-2013/014888 | A1 | 1/2013 |

OTHER PUBLICATIONS

Hung, et al., "Digital LED Desk Lamp with Automatic Uniform Illumination Area by Using Two Accelerometers and Halftone Method" IEEE ISCE 2014 1569933999.

Minebea, "A revolutionary lighting able to completely control light, created by combining the application of optical technology with precision components", 2017, http://www.minebeamitsumi.com/english/strengths/column/saliot/index.html.

Minebea, "Minebea to Start Mass Production and Sales of New LED Lighting (Smart Adjustable Light for IoT (SALIOT))", Jul. 15, 2015 Press Release, http://www.minebeamitsumi.com/english/news/press/2015/1189602_7564.html.

* cited by examiner

*Primary Examiner* — Matthew Mikels
(74) *Attorney, Agent, or Firm* — Foley & Lardner LLP

(57) ABSTRACT

A lighting device assembly includes: a heat sink; a light source attached to one end of the heat sink; and an optic assembly including an optic having a recess to receive at least a portion of the light source, the optic being configured to pivot about the light source while the portion of the light source remains within the recess.

20 Claims, 4 Drawing Sheets

ADJUSTABLE OPTIC AND LIGHTING DEVICE ASSEMBLY

This application is a Continuation Application of U.S. patent application Ser. No. 15/828,243 filed Nov. 30, 2017, the entire contents of which are fully incorporated herein by reference in its entirety.

BACKGROUND

Lighting devices such as, but not limited to, track lights, can include configurations that allow for adjustment of the direction of emitted light or light beam. Such lighting devices may include a light source, such as a light emitting diode (LED). Typically, the brightness of an LED light source is directly related to the speed in which heat can be transferred away from the LED component, which should desirably be maintained under about 105° Celsius. However, if the LED component is mounted on a moveable structure, such as a free floating fixture head that is movable to adjust a light beam direction, heat may not be efficiently transferred from the LED component through the moveable structure. Therefore, the brightness of light emitted from the LED light source may be reduced.

If the lighting device has a light source that is mounted directly to a fixture housing of substantial mass and suitable heat conductive material, the fixture housing may help to dissipate heat away from the LED light source, to improve LED performance. However, in lighting devices having light sources fixed to fixture housings of sufficient mass for heat dissipation, it may not be possible to adjust the direction of a downlight beam. In addition, if the lighting device includes a fixture head that is moveable together with the optics to adjust the direction of emitted light, some light may be blocked by the bezel or housing containing the optics and light source, when the fixture head is moved.

SUMMARY

One or more examples and aspects described herein relate to an optic assembly having an adjustable optic in which loss of light is reduced. Other examples and aspects described herein relate to a lighting device and a lighting device assembly including that optic assembly. One or more examples and aspects described herein relate to an optic assembly having an adjustable optic, a lighting device or a lighting device assembly that includes that optic and has improved heat transfer characteristics.

According to an example embodiment, a lighting device assembly includes: a heat sink; a light source attached to one end of the heat sink; and an optic assembly including an optic having a recess configured to receive at least a portion of the light source, the optic being configured to pivot about the light source while the portion of the light source remains within the recess.

In an example embodiment, the recess may include a focal point of the optic within a depth of the recess, and the recess may configured to keep the portion of the light source at the focal point of the optic throughout a full range of motion of the optic.

In an example embodiment, a width of the recess may be greater than a width of the heat sink, and the recess may be configured to receive at least a portion of the heat sink.

In an example embodiment, the recess may include a side wall, and the top edge of the side wall may be configured to contact a sidewall of the heat sink to limit a degree amount of pivoting by the optic.

In an example embodiment, the lighting device may further include: a housing member having a cavity configured to hold the optic assembly, and the optic assembly may be configured to slideably engage the cavity of the housing member.

In an example embodiment, the optic assembly may include a holding member configured to receive the optic, the holding member having a curved outer surface configured to slideably engage a curved surface of the cavity of the housing member.

In an example embodiment, the holding member may be configured to pivot the optic about the light source in a 360 degree plane.

In an example embodiment, the lighting device assembly may further include a friction member, and the holding member may be configured to slideably engage the friction member to maintain a pivoted position of the optic.

In an example embodiment, the lighting device assembly may further include a top member configured to enclose the housing member, and another end of the heat sink opposite to the one end may be exposed through the top member.

In an example embodiment, the other end of the heat sink may be configured to contact a surface of an object to which the lighting device is mounted to transfer heat from the light source to the object.

According to an example embodiment of the present invention, an optic assembly includes: an optic having a recess configured to receive at least a portion of a light source; and a holding member configured to receive the optic, and to slideably engage a cavity of a housing member in which the holding member is received to pivot the optic about the light source while the portion of the light source remains within the recess.

In an example embodiment, the recess may include a focal point of the optic within a depth of the recess, and the recess may be configured to keep the portion of the light source at the focal point of the optic throughout a full range of motion of the optic.

In an example embodiment, the recess may include: a sidewall; and a bottom surface facing the light source. A top edge of the sidewall may be configured to limit a degree amount of pivoting by the optic.

According to an example embodiment of the present invention, a lighting device includes: a fixture housing configured to dissipate heat from a light source; and a lighting device assembly attached to the fixture housing, the lighting device assembly including: a heat sink having one end contacting the fixture housing, and configured to transfer heat from the light source to the fixture housing; the light source attached to another end of the heat sink opposite to the one end; and an optic assembly including an optic having a recess configured to receive at least a portion of the light source, the optic being configured to pivot about the light source while the portion of the light source remains within the recess.

In an example embodiment, the recess may include a focal point of the optic within a depth of the recess, and the recess may be configured to keep the portion of the light source at the focal point of the optic throughout a full range of motion of the optic.

In an example embodiment, the heat sink and the light source may be fixed relative to the fixture housing, and the optic may be pivotally moveable relative to the fixture housing.

In an example embodiment, the recess may include a side wall, and the top edge of the side wall may be configured to contact a sidewall of the heat sink to limit a degree amount of pivoting by the optic.

In an example embodiment, the lighting device assembly may further include: a housing member having a cavity configured to hold the optic assembly, and the optic assembly may be configured to slideably engage the cavity of the housing member.

In an example embodiment, the lighting device assembly may further include a friction member, and the optic assembly may be configured to slideably engage the friction member to maintain a pivoted position of the optic.

In an example embodiment, the lighting device assembly may further include a top member configured to enclose the housing member, and the one end of the heat sink may be exposed through the top member to contact the fixture housing.

BRIEF DESCRIPTION OF THE DRAWINGS

The above and other aspects and features of the present invention will become more apparent to those skilled in the art from the following detailed description of the example embodiments with reference to the accompanying drawings, in which.

DETAILED DESCRIPTION

Figure 1A:
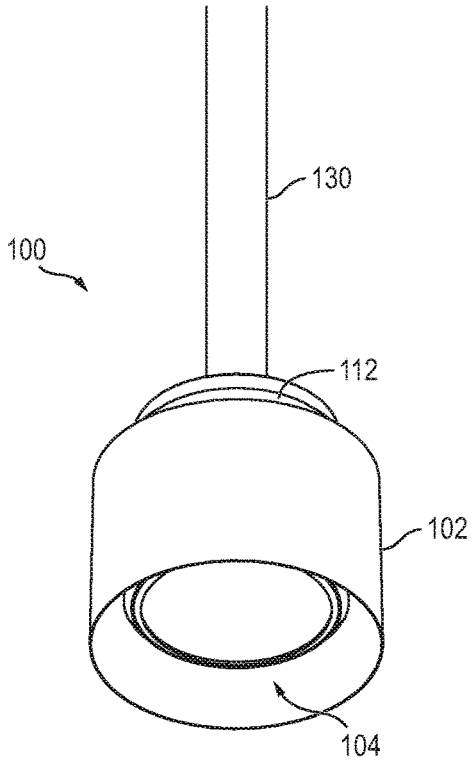
FIGS. 1A and 1B are perspective views of a lighting device assembly according to various example embodiments.

Hereinafter, example embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. Further, features or aspects within each example embodiment should typically be considered as available for other similar features or aspects in other example embodiments.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," "has, " "have, " and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

According to various embodiments, a light source of a lighting device assembly may be attached to one end of a heat sink, and another end of the heat sink may be closely related to (integral or in contact with) a surface of an object (e.g., a fixture housing or other object of sufficient heat conveying mass) to which the lighting device assembly is mounted. Accordingly, heat transferred from the light source may be improved.

According to various embodiments, the light source of the lighting device assembly may be extended within a recess of an optic, and the optic may move (e.g., pivot and/or rotate) freely about the light source while the light source remains within the recess of the optic and in a fixed relation with the optic. Accordingly, light emitted from the light source may be beam-shifted to a portion of the optic that is pivoted outward, and thus, light loss may be reduced.

Figure 1B:
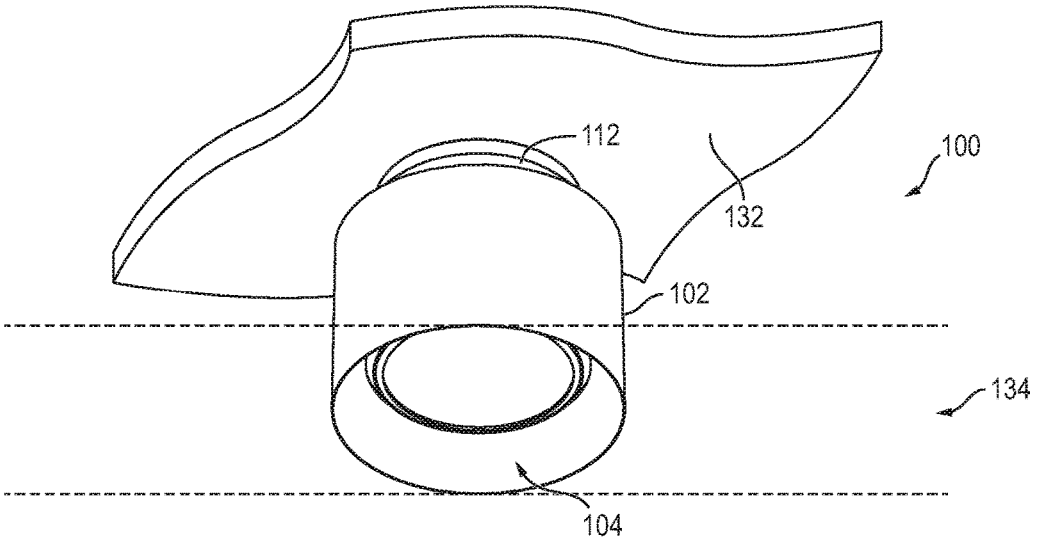

FIGS. 1A and 1B are perspective views of two examples of a lighting device assembly according to various embodiments of the present invention, where like elements in those drawings are labeled with like reference numbers. Referring to FIGS. 1A and 1B, the lighting device assembly 100 may include a housing member (or a bezel) 102, an optic assembly 104, and a top member (e.g., a mounting bracket) 112. The optic assembly 104 may pivot and/or rotate within the housing member 102 to adjust a direction of emitted light. While FIGS. 1A and 1B show that the housing member 102 generally has a cylindrical shape, other embodiments may include housing members 102 having other suitable shapes, including but not limited to curved or partially spherical shapes, conical, cube or cuboid shapes, rectangular shapes, triangular shapes, or the like.

In various embodiments, the lighting device assembly 100 may be mounted to various structures and/or incorporated into various structures. For example, as shown in FIG. 1A, the lighting device assembly 100 may be attached to an end of an extension member (e.g., a rod or pole) 130, as in the case of a pendent light, desk light, lamp, and the like. In some other examples, as shown in FIG. 1B, the lighting device assembly 100 may be mounted to a surface of an object (such as, but not limited to, a fixture housing, track lighting, downlights, linear lights, board, ceiling, wall, floor, and the like) 132, or may be recessed into a surface of an object (such as, but not limited to a ceiling, wall, floor, shelf, cabinet, and the like) 134. Further, in various embodiments, a plurality of lighting device assemblies 100 may be arranged in various combinations as desired. While FIGS. 1A and 1B show two examples of lighting device shapes and relative dimensions, other embodiments have other suitable shapes and relative dimensions.

Figure 2:
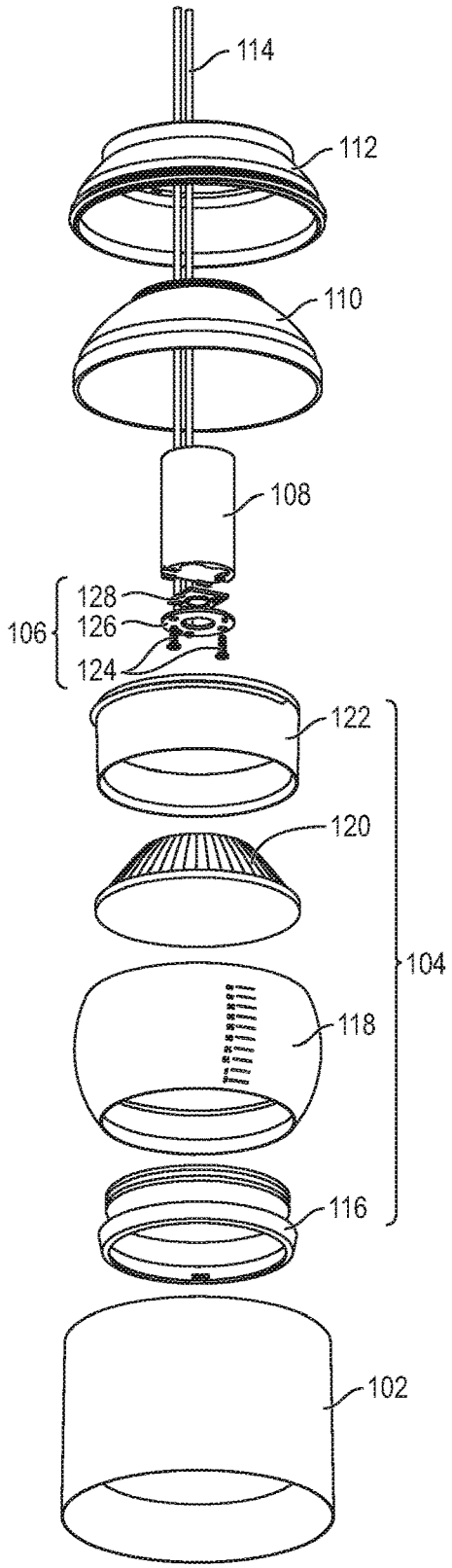
FIG. 2 is an exploded view of a lighting device assembly according to an example embodiment.
Figure 3:
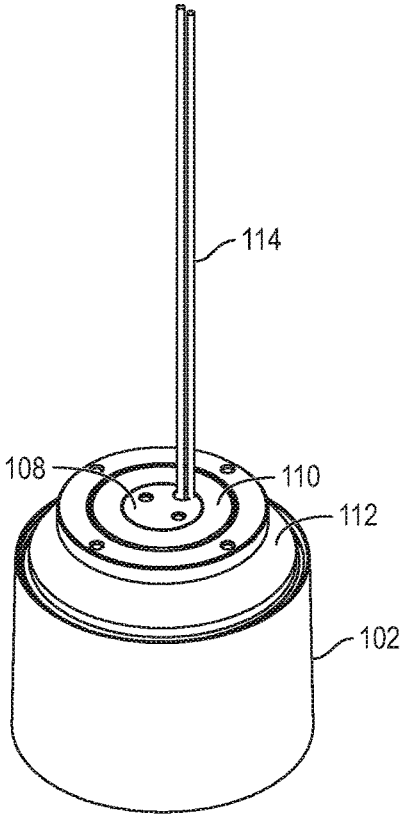
FIG. 3 is a perspective top view of a lighting device assembly according to an example embodiment.

FIG. 2 is an exploded view of a lighting device assembly according to an embodiment of the present invention, and FIG. 3 is a perspective top view of a lighting device assembly according to an embodiment of the present invention. Referring to FIG. 2, the lighting device assembly 100 may include the housing member 102, an optic assembly 104, a light source assembly 106, a heat sink 108, a friction member 110, and the top member 112. In various embodiments, one or more wires 114 for electrically connecting a light source of the light source assembly 106 to a power source may extend through the top member 112 (e.g., via the heat sink 108 as shown in FIG. 3), but the present invention is not limited thereto. For example, in a case where the light source is powered by a battery, the wires 114 may not extend through the top member 112 or may be omitted. In other embodiments, the wires 114 may extend from a side of the top member 112, or the like.

In various embodiments, the optic assembly 104 may include a lens filter 116, a holding member 118, an optic 120 (one or more lens, filter or combination thereof), and a locking member (e.g., a locking ring) 122. The lens filter 116 may change a characteristic of emitted light (e.g., color, brightness, focus, polarization, linear spread filter, wall wash filter, baffles, glare guards, snoots, and/or the like). However, the present invention is not limited thereto, and the lens filter 116 may be optional or omitted.

The holding member 118 receives the optic 120, and may facilitate the movement (e.g., pivot and/or rotation) of the optic 120 within the housing member 102. For example, the holding member 118 may slideably engage a cavity of the housing member 102 in a ball and socket manner. In various embodiments, the holding member 118 may have an outer surface having a curvature that is held within a corresponding cavity (with a corresponding mating curvature and dimension) within the housing member 102. For example, the outer surface of the holding member 118 may have a shape of a portion of a sphere, and may be held within a corresponding sphere-shaped cavity within the housing member 102. Accordingly, the optic 120 may pivot in any direction (e.g., on a 360 degree plane) within the housing member 102, by slideably engaging the cavity of the housing member 102. However, the present invention is not limited thereto, and in another embodiment, the pivoting directions of the optic 120 may be limited or reduced, for example, by providing stop surfaces or a shape of the surface of the holding member 118 and/or a shape of the cavity within the housing member 102, that limits movement in one or more directions.

The optic 120 may include a recess R or opening (discussed below with reference to FIG. 4) on a surface facing the light source assembly 106. The recess R may receive at least a portion of the light source assembly 106 and heat sink 108. In various embodiments, the light source assembly 106 and heat sink 108 may extend at least partially into the recess R, and may remain at least partially within the recess R throughout the full range of adjustable movement (e.g., pivot and/or rotation) of the optic 120 (described in more detail below with reference to FIGS. 4-6).

The locking member 122 may lock the optic 120 to the holding member 118. For example, the locking member 122 may have a tubular (or ring) shape, and may lock (e.g., twist-lock) the optic 120 at a position within the holding member 118. The light source assembly 106 and heat sink 108 may extend through the locking member 122 into the recess of the optic 120. However, the present invention is not limited thereto, and in other embodiments, the locking member 122 may be omitted. For example, in other embodiments, the optic 120 may have a self-locking (e.g., twist-lock) mechanism to be locked within the holding member 118, and in this case, the locking member 122 may be omitted.

In various embodiments, the light source assembly 106 may include a light source 128. The light source 128 may include, for example, one or more light emitting diodes (LEDs), or an array of multiple LEDs. However, the present invention is not limited thereto, and in other embodiments, the light source 128 may include any suitable light source (e.g., LED, incandescent, halogen, fluorescent, combinations thereof, and/or the like). In some embodiments, the light source 128 may emit white light. In other embodiments, the light source 128 may emit any suitable color or frequency of light, or may emit a variety of colored lights. For example, when the light source includes an array of LEDs, each of the LEDs (or each group of plural groups of LEDs in the array) may emit a different colored light (such as, but not limited to white, red, green, and blue), and, in further embodiments, two or more of the different colored lights may be selectively operated simultaneously to mix and produce a variety of different colored lights, or in series to produce light that changes in color over time.

In various embodiments, the light source assembly 106 may further include an attachment element 124 and a frame member 126. The light source 128 may be attached (or mounted) to the heat sink 108 via the attachment element 124 and the frame member 126. For example, the frame member 126 may be arranged over the light source 128, and connected to the heat sink 108 via the attachment element 124 with the light source 128 interposed therebetween. The attachment element 124 may include one or more of any suitable attachment elements, for example, a screw, a nail, a clip, an adhesive, and/or the like. However, the present invention is not limited thereto, and in other embodiments, the frame member 126 may be omitted, and the light source 128 may be directly attached (or mounted) to the heat sink 108.

In various embodiments, the heat sink 108 may draw heat away from the light source 128. Accordingly, the heat sink 108 may be made of any suitable material, composition, or layers thereof having sufficient heat transfer and/or dissipation qualities, for example, aluminum, copper, and/or the like. In an example embodiment, the heat sink 108 may be formed (e.g., cast) from solid aluminum. The heat sink 108 may have a shape corresponding to an elongated body (e.g., a pedestal) that extends from the top member 112 to the recess of the optic 120. The heat sink 108 may be in direct contact with the light source assembly (and, in particular, with the light source 128) and may extend the light source assembly 106 at least partially into the recess of the optic 120. In particular embodiments, the heat sink 108 holds the light source assembly 106 in a position in which the light source assembly 106 remains fully within the recess of the optic 120, throughout the full range of adjustable movement (e.g., pivot and/or rotation) of the optic 120 within the holding member 118, such that all light emitted from the light source assembly 106 passes through the optic 120 (with minimal loss). In other embodiments, the light source assembly 106 is held in a position in which the light source assembly 106 remains fully within the recess of the optic 120, throughout some, but not the full extent of motion of the optic 120 within the holding member 118. In an example embodiment, the heat sink 108 may also be partially extended into the recess of the optic 120, and may remain at least partially within the recess of the optic 120 throughout the full range of adjustable movement (e.g., pivot and/or rotation) of the optic 120.

In various embodiments, an end of the heat sink 108 may be exposed through the top member 112, for example, as shown in FIG. 3. Accordingly, when the light device assembly 100 is attached (or mounted) to a surface of an object 132 as shown in FIG. 1B, for example, the heat sink 108 may be arranged in heat-transfer communication with the object 132, to conduct heat away from the light source 128 to the object 132. In an example embodiment, the heat sink 108 may be arranged in direct contact with the surface of the object 132. In this case the object (e.g., a fixture housing) 132 may be made of any suitable material, composition, or layers thereof having suitable thermal conductance and/or heat dissipation characteristics, for example, such as copper, aluminum, steel, and/or the like. In some embodiments, the object 132 may include, for example, heat pipes, peltier coolers, fan/heatsink combo, water cooling systems, refrigerant systems, and/or the like.

The friction member 110 may provide a friction surface to maintain a pivoted position of the optic 120 and the holding member 118 within the housing member 102. For example, when the optic 120 is pivoted (with the holding member 118) to a desired position within the housing member 102, the friction surface of the friction member 110 frictionally engages the outer surface of the holding member 118, to prevent or substantially prevent the holding member 118 from shifting to a different position from the desired position due to gravity (i.e., without manual force). Preferably, the frictional force may be overcome by manual force applied to manually adjust or move (pivot and/or rotate) the optic 120 and the holding member 118 relative to the housing member 102. Accordingly, the friction member 110 or the engaging surface of the holding member 118 may include any suitable material to provide the friction surface, for example, but not limited to, silicone, rubber, and/or the like. In further examples, the friction surface of the friction member 110 or the engaging surface of the holding member 118 includes contour, roughness or other features that enhance friction. In an embodiment, the friction member 110 may have a shape of an upper hemisphere of a sphere, so that the engaging surface of the holding member 118 can slideably engage with the friction member 110. However, the present invention is not limited thereto, and in some embodiments, the friction member 110 may be omitted. In this case, an interior surface of the cavity of the housing member 102 and/or an exterior surface of the holding member 118 may include a friction surface as described above, to maintain a pivoted position of the optic 120.

The top member 112 may enclose the top of the housing member 102. For example, the top member 112 may include threading that mates with threading of the housing member 102, to be twist-locked on the housing member 102. However, the present invention is not limited thereto, and the top member 112 may enclose or connect to the top of the housing member 102 via any suitable method, such as, but not limited to, mating tabs and/or grooves, clips, screws, nails, adhesives, welding, combinations thereof, or the like.

As shown in FIG. 3, in various embodiments, the end of the heat sink 108 may be exposed through the top member 112. Accordingly, the heat sink 108 may be in close relation with (or contact) a surface of an object on which the lighting device assembly 100 is mounted, and may conduct heat from the light source 128 to the surface of the object. In a further example embodiment, an end of the friction member 110 may be interposed between the end of the heat sink 108 and the top member 112. In that embodiment, the end of the friction member 110 may also be exposed through the top member 112 between the heat sink 108 and a top surface of the top member 112.

Figure 4:
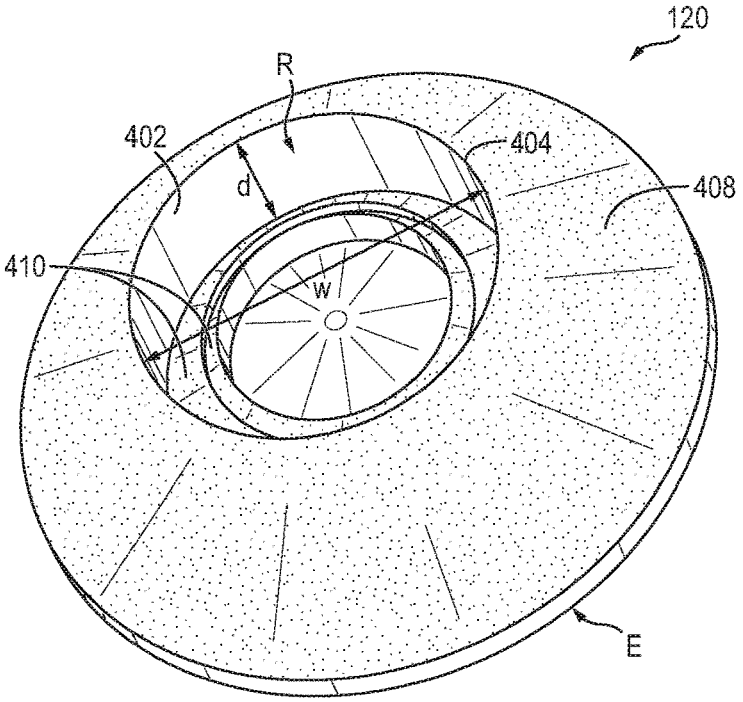
FIG. 4 is a perspective view of an optic of a lighting device assembly according to an example embodiment.

FIG. 4 is a perspective view of an optic of a lighting device assembly according to an example embodiment of the present invention. Referring to FIG. 4, the optic 120 includes a recess R. In various embodiments, the light source 128 and the heat sink 108 extend at least partially into the recess R of the optic 120. In various embodiments, the light source 128 (e.g., via the heat sink 108) remains at least partially in the recess R throughout the full range of motion (e.g., pivot and/or rotation) of the optic 120 (e.g., via the holding member 118). In various embodiments, the light source 128 remains stationary with respect to the housing member 102 and friction member 110, such that the optic 120 may freely move and pivot relative to and around the light source 128.

In various embodiments, optic 120 includes a side wall 402 having a top edge 404 that defines the recess R. A focal point of the optic 120 is located within a depth d of the recess R, such that the light source 128 remains at the focal point throughout the full range of motion (e.g., pivot and/or rotation) of the optic 120. In various embodiments, a width (or diameter) w of the recess R may limit a maximum degree amount (e.g., 10°, 30°, 45°, and the like) that the optic 120 may pivot about the light source 128. For example, the maximum degree amount that the optic 120 may pivot about the light source 128 may correspond to the width w of the recess R and a width (or diameter) of the heat sink 108 within the recess R, such that the optic 120 may pivot about the light source 128 until the top edge 404 of the recess R contacts a side wall of the heat sink 108. Accordingly, in various embodiments, the width w of the recess R may be wider than the width of the heat sink 108 such that at least a portion of the heatsink 108 may be received within the recess R, and may remain within the recess R to allow the optic 120 to pivot about the light source 128 by a desired degree amount.

In various embodiments, an upper surface 408 of the optic 120 may include a reflective surface (e.g., provided by a layer or coating of reflective material, contours, or combination thereof) to reflect light towards an emitting surface E of the optic 120. In various embodiments, the bottom surface of the recess R of the optic 120 may include one or more reflective elements 410 to reflect light towards the emitting surface E of the optic 120. In some embodiments, each of the reflective elements 410 may have an inner annular side surface that is perpendicular or substantially perpendicular to a focal axis of the optic 120, and an outer annular side surface that is angled relative to the focal axis of the optic 120. The angle of the outer annular side surface of each of the reflective elements 410 may slope downward (e.g., towards the emitting surface E) and outward (e.g., towards the sidewall 402). In some embodiments, the outer annular side surface may include a reflective surface (e.g., provided by a layer or coating of reflective material, contours, or combination thereof), to reflect light towards the emitting surface E of the optic 120. However, the present invention is not limited thereto, and the reflective elements 410 may be omitted or may have different shapes.

Figure 5:
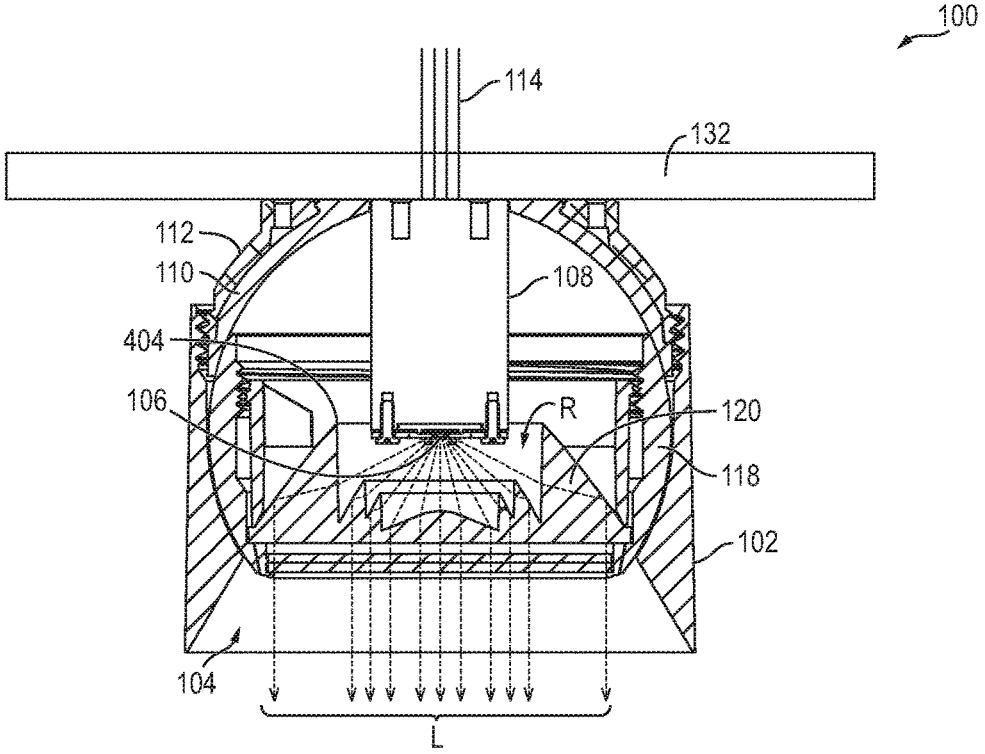
FIG. 5 is a cross-sectional view of a lighting device with the optic in a first position according to an example embodiment.
Figure 6:
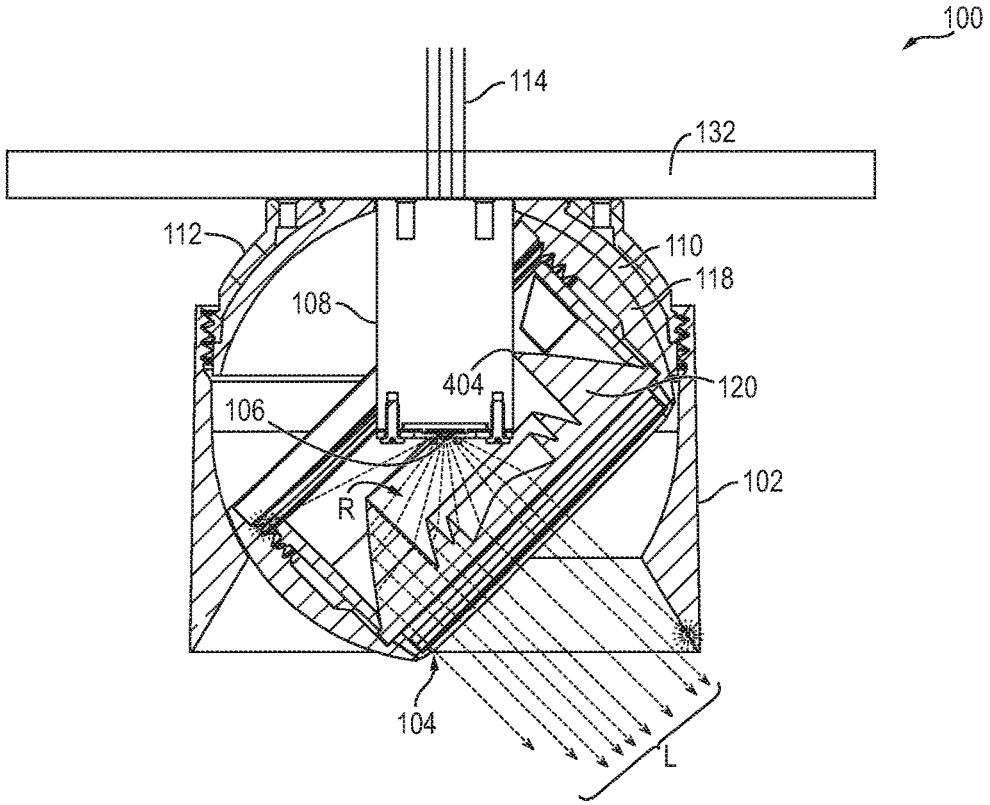
FIG. 6 is a cross-sectional view of the lighting device in FIG. 5 with the optic in a second position according to an example embodiment.

FIG. 5 is a cross-sectional view of a lighting device with the optic in a first position according to an embodiment of the present invention, and FIG. 6 is a cross-sectional view of the lighting device with the optic in a second position according to an embodiment of the present invention. Referring to FIGS. 4-6, the lighting device assembly 100 includes the housing member 102, the optic assembly 104 held in the cavity of the housing member 102, the light source assembly 106 attached (e.g., mounted) at an end of the heat sink 108, the friction member 110, and the top member 112. One end of the heat sink 108 is exposed through the top member 112, and may contact a surface of the object (e.g., a fixture housing) 132. Accordingly, the heat sink 108 may conduct heat away from the light source 128 directly to the object 132. The other end of the heat sink 108 on which the light source assembly 106 is attached (e.g., mounted) extends at least partially within the recess R of the optic 120. Accordingly, the light source assembly 106 extends at least partially within the recess R of the optic 120, and the optic 120 may freely move and pivot about the light source 128.

As shown in FIGS. 5 and 6, the light source 128 may be stationary with respect to the housing member 102 and the friction member 110, while the optic 120 may freely move and pivot about the light source 128. When the optic assembly 104 is pivoted from the first position to the second position, the exterior surface of the holding member 118 slideably engages with the cavity of the housing member 102 and the friction surface of the friction member 110. Accordingly, the friction member 110 maintains (or holds) the pivoted position of the holding member 118 against movement by gravity. According to an example embodiment, the housing member 102 may be loosened from the top member 112 (e.g., via twisting motion), and then tightened to the top member 112 (e.g., via twisting motion) after the optic assembly 104 is pivoted from the first position to the second position, so that a side of the holding member 118 is pressed into the friction member 110 and locked in the second position.

In various embodiments, the light source assembly 106 extends at least partially within the recess R of the optic 120 in each of the first position and the second position of the optic 120, and the light source 128 may be stationary with respect to the housing member 102 and the friction member 110, such that the optic 120 may freely move and pivot about the light source 128. The maximum amount or degree that the optic 120 can pivot about the light source assembly 106 may be limited by the width (or diameter) w of the recess R and the width (or diameter) of the side wall of the heat sink 108. For example, as shown in FIG. 6, the degree amount that the optic 120 may pivot may reach its maximum when the top edge 404 of the recess R contacts the sidewall of the heat sink 108. Accordingly, the width w (see FIG. 4) of recess R may be wider than the width of the heat sink 108 according to a desired maximum degree amount of pivot.

In various embodiments, the light source 128 of the light source assembly 106 may be stationary with respect to the housing member 102 and the friction member 110, and may remain at the focal point of the optic 120 within the depth d of the recess R throughout the full range of motion of the optic 120. Accordingly, as shown in FIG. 6, even when the optic 120 is pivoted, a portion of the light L that is emitted from the light source 128 may be beam-shifted to a portion of the optic 120 that is pivoted outward, such that substantially all of the light L emitted from the light source 128 is directed through the central region of the optic 120. In other lighting device assemblies where the light source 128 and the optic 120 are moved (or pivoted) together, the light L would normally be blocked by the housing member 102. However, according to various embodiments, the light L that would normally be blocked by the housing member 102 (e.g., if the light source 128 and optic 120 are moved together as in other lighting device assemblies) is beam-shifted to a portion of the optic 120 that has pivoted or rotated outward, to avoid (e.g., not be blocked by) the housing member 102 and minimize light loss.

As discussed above, in various embodiments, heat may be transferred from the light source directly to a surface of an object (e.g., fixture housing) via the heat sink, and thus, heat transferred from the light source may be improved, and brightness of the light source may be improved. Further, in various embodiments, the optic may move (e.g., pivot and/or rotate) freely about a stationary light source, while keeping at least a portion of the light source within a recess of the optic throughout the full range of motion of the optic, to minimize light loss.

The foregoing description of illustrative embodiments has been presented for purposes of illustration and of description. It is not intended to be exhaustive or limiting, and modifications and variations may be possible in light of the above teachings or may be acquired from practice of the disclosed embodiments. Various modifications and changes that come within the meaning and range of equivalency of the claims are intended to be within the scope of the invention. Thus, while certain embodiments of the present invention have been illustrated and described, it is understood by those of ordinary skill in the art that certain modifications and changes can be made to the described embodiments without departing from the spirit and scope of the present invention as defined by the following claims, and equivalents thereof.

What is claimed is:

1. A lighting device assembly configured to be mounted to a structure, the lighting device assembly comprising:

a heat sink configured to be stationary relative to the structure, when the lighting device assembly is mounted to the structure;

a light source attached to one end of the heat sink; and an optic assembly including an optic having a recess configured to receive at least a portion of the light source, the optic being configured to pivot about the light source while the portion of the light source remains within the recess and while the heat sink is stationary relative to the structure.

2. The lighting device assembly of claim 1, wherein the recess includes a focal point of the optic within a depth of the recess, and the recess is configured to keep the portion of the light source at the focal point of the optic throughout a full range of motion of the optic.

3. The lighting device assembly of claim 1, wherein a width of the recess is greater than a width of the heat sink, and the recess is configured to receive at least a portion of the heat sink.

4. The lighting device assembly of claim 3, wherein the optic includes a side wall defining the recess, and the top edge of the side wall is configured to contact a sidewall of the heat sink to limit a degree amount of pivoting by the optic.

5. The lighting device assembly of claim 1, further comprising:

a housing member having a cavity configured to hold at least a portion of the optic assembly and to be stationary relative to the heat sink, while the optic pivots about the light source, wherein the optic assembly is configured to slideably engage the cavity of the housing member while the optic pivots about the light source.

6. The lighting device assembly of claim 5, wherein the optic assembly includes a holding member configured to receive the optic, the holding member having a curved outer surface configured to slideably engage a curved surface of the cavity of the housing member.

7. The lighting device assembly of claim 6, wherein the holding member is configured to pivot the optic about the light source in a 360 degree plane.

8. The lighting device assembly of claim 7, further comprising a friction member, and the holding member is configured to slideably engage the friction member to maintain a pivoted position of the optic against gravity.

9. The lighting device assembly of claim 5, further comprising a top member configured to enclose the housing member, wherein another end of the heat sink opposite to the one end is exposed through the top member.

10. The lighting device assembly of claim 9, wherein the other end of the heat sink is configured to contact a surface of an object to which the lighting device is mounted to transfer heat from the light source to the object.

11. An optic assembly comprising:

an optic having a recess configured to receive at least a portion of a light source; and a holding member configured to receive the optic, and to slideably engage a cavity of a housing member in which the holding member is received to pivot the optic about the light source while the portion of the light source remains within the recess.

12. The optic assembly of claim 11, wherein the recess includes a focal point of the optic within a depth of the recess, and the recess is configured to keep the portion of the light source at the focal point of the optic throughout a full range of motion of the optic.

13. The optic assembly of claim 11, wherein the recess includes:

a sidewall; and a bottom surface facing the light source, wherein a top edge of the sidewall is configured to limit a degree amount of pivoting by the optic.

14. A lighting device, comprising:

a fixture housing configured to dissipate heat from a light source; and a lighting device assembly attached to the fixture housing, the lighting device assembly comprising:

a heat sink having one end contacting the fixture housing, and configured to transfer heat from the light source to the fixture housing, the heat sink configured to be stationary relative to the fixture housing;

the light source attached to another end of the heat sink opposite to the one end; and an optic assembly including an optic having a recess configured to receive at least a portion of the light source, the optic being configured to pivot about the light source while the portion of the light source remains within the recess and while the heat sink is stationary relative to the fixture housing.

15. The lighting device of claim 14, wherein the recess includes a focal point of the optic within a depth of the recess, and the recess is configured to keep the portion of the light source at the focal point of the optic throughout a full range of motion of the optic.

16. The lighting device of claim 14, wherein the heat sink and the light source are fixed relative to the fixture housing, and the optic is pivotally moveable relative to the fixture housing.

17. The lighting device of claim 16, wherein the optic includes a side wall defining the recess, and the top edge of the side wall is configured to contact a sidewall of the heat sink to limit a degree amount of pivoting by the optic.

18. The lighting device of claim 14, wherein the lighting device assembly further comprises:

a housing member having a cavity configured to hold at least a portion of the optic assembly and to be stationary relative to the heat sink, while the optic pivots about the light source, wherein the optic assembly is configured to slideably engage the cavity of the housing member while the optic pivots about the light source.

19. The lighting device of claim 18, wherein the lighting device assembly further comprises a friction member, and the optic assembly is configured to slideably engage the friction member to maintain a pivoted position of the optic.

20. The lighting device of claim 19, wherein the lighting device assembly further comprises a top member configured to enclose the housing member, wherein the one end of the heat sink is exposed through the top member to contact the fixture housing.

* * * * *